US006390709B1

(12) United States Patent
Zerebecki et al.

(10) Patent No.: US 6,390,709 B1
(45) Date of Patent: May 21, 2002

(54) ADHESIVE DISPENSER FOR APPLYING ADHESIVE TO GROOVED FLOORING PLANKS AND METHOD OF APPLYING ADHESIVE

(75) Inventors: Nicholas Zerebecki, Mullica Hill; James Giordano, Carneys Point, both of NJ (US)

(73) Assignee: Mannington Mills, Inc., Salem, NJ (US)

( * ) Notice: Subject to any disclaimer, the term of this patent is extended or adjusted under 35 U.S.C. 154(b) by 0 days.

(21) Appl. No.: 09/818,267

(22) Filed: Mar. 27, 2001

Related U.S. Application Data

(60) Provisional application No. 60/192,760, filed on Mar. 28, 2000.

(51) Int. Cl.[7] ..... B43K 29/00

(52) U.S. Cl. ..... 401/193; 401/266; 401/265

(58) Field of Search ..... 401/193, 261, 401/265, 266; 222/566, 567, 568, 570, 569

(56) References Cited

U.S. PATENT DOCUMENTS

| | | | | |
|---|---|---|---|---|
| 1,208,865 | A | | 12/1916 | Warwick |
| 1,980,552 | A | | 11/1934 | Ryan |
| 2,877,480 | A | | 3/1959 | Warren |
| 3,352,623 | A | * | 11/1967 | Sanet |
| 3,748,049 | A | | 7/1973 | Knupfer et al. |
| 3,811,783 | A | | 5/1974 | Johnson |
| 4,484,976 | A | * | 11/1984 | Despins ..... 401/193 |
| 5,078,527 | A | | 1/1992 | Bell |
| 5,516,224 | A | | 5/1996 | Moshammer |
| 5,658,384 | A | | 8/1997 | Imlay, Jr. |
| 5,882,133 | A | | 3/1999 | Chao et al. |

FOREIGN PATENT DOCUMENTS

| | | |
|---|---|---|
| RU | 609623 | 3/1978 |

* cited by examiner

*Primary Examiner*—David J. Walczak
(74) *Attorney, Agent, or Firm*—Kilyk & Bowersox, P.L.L.C.

(57) ABSTRACT

An adhesive dispenser includes a dispenser body having a reservoir containing an adhesive, and a tip. The tip has a guide member that extends in a first direction away from the body and is shaped to fit within a groove of a grooved flooring plank. The guide member has opposing top and bottom surfaces and opposing end surfaces. An orifice is in communication with a conduit that opens into said reservoir. An elongated channel intersects the top surface of the guide member and extends in a second direction that is substantially perpendicular to the first direction. The elongated channel has a sidewall and the orifice includes an opening that is at least partially formed in the sidewall. A method of applying adhesive into the groove of a grooved flooring plank includes the steps of inserting the guide member into the groove of a grooved flooring plank, and expelling adhesive from the reservoir though the orifice. The channel shapes the adhesive as it enters the groove and the dispenser design confines the expelled adhesive to a bead that contacts only a desired portion of the groove.

21 Claims, 4 Drawing Sheets

12
42
.030
44
20
36
40
46
16
.020
.066
52
15.00°
.143

.430
.900
V
R.020
R.010
28
20
36
18
42
22
R.020

14
20
12
28
22
R.030
.510
1.190

46
12
24
20
26
44
28
16
R.060

IV
Φ.125
20
28
24
26
22
Φ.537
IV

ADHESIVE DISPENSER FOR APPLYING ADHESIVE TO GROOVED FLOORING PLANKS AND METHOD OF APPLYING ADHESIVE

This application claims the benefit under 35 U.S.C. § 119(e) of prior U.S. Provisional Patent Application No. 60/192,760 filed Mar. 28, 2000, which is incorporated in its entirely by reference herein.

BACKGROUND OF THE INVENTION

The present invention relates to an adhesive dispenser, and more particularly to a glue applicator tip specially designed for dispensing adhesive into the groove of a grooved flooring plank.

To properly install most tongue-and-groove laminate flooring planks, particularly those made with medium density fiber (MDF) and high density fiber (HDF) board, a good adhesive and proper application of adhesive is necessary. The adhesive plays a vital role in laminate floor performance. The adhesive acts as a bonding agent to hold adjacent planks together and also acts like a grout sealer between the planks to keep water and dirt from getting in-between the planks.

Most bottles of adhesive for laminate floor installations are standard sized 16 oz. bottles having a round coned top. The top can be cut off at a specific angle and a certain height to allow the adhesive to flow through the tip. Depending on how the tip is cut, an improper angle or an improper opening size can result, causing problems with delivering too much or too little adhesive, and the adhesive may contact undesirable portions of the groove and/or plank. In addition, it is up to the floor installer to regulate how the tip is positioned with respect to the groove and how much pressure is used to squeeze the adhesive out of the bottle. Other commercially available glue dispenser caps are rectangular but are used like coned tops. Rectangular tops also have problems with positioning along the plank edge and controlling the amount of adhesive and placement of adhesive exactly where it is needed.

With the improper placement or improper amount of adhesive, problems can arise with the installation of laminate flooring planks including problems with installation and with floor performance. Excessive adhesive makes it difficult to push adjacent planks together due to hydrostatic pressure, which can lead to gaps between adjacent planks. Gaps can create excess swelling along the plank edges due to water pick-up. Gaps can also trap dirt and create black lines along the planks. In addition, the application of excessive amounts of adhesive can also be very messy and requires increased clean-up time. Excess water from excess water-based adhesive can also create swelling on the plank edges.

A need exists for an adhesive dispenser that consistently and repeatably provides a bead of adhesive at a proper location and in a proper amount along the groove of a grooved flooring plank.

SUMMARY OF THE INVENTION

The present invention provides an adhesive dispenser which is particularly well suited for dispensing a proper amount of adhesive to a proper location in a groove of a grooved flooring plank while overcoming the problems associated with the prior glue applicators discussed above. To achieve these objectives, an adhesive dispenser with an adhesive applicator tip is provided according to the present invention, wherein the tip is specially designed for precise dispensing of adhesive into the groove of a grooved flooring plank. The dispenser tip preferably includes a specially designed channeling system that limits the application of glue only to certain desirable locations along the flooring plank groove. The adhesive dispenser of the present invention provides optimal bonding between adjacent grooved flooring planks with a minimum amount of glue while at the same time minimizing plank swelling by reducing the application of excessive amounts of adhesive. The adhesive dispenser of the present invention facilitates grooved flooring plank installations and reduces adhesive waste.

These and other features of the present invention are achieve according to an embodiment of the present invention wherein an adhesive dispenser has a body having a reservoir containing an adhesive and a specially designed dispensing tip. The reservoir can be in communication with a supply of adhesive, such as a 16 oz. bottle of flooring adhesive. The tip has a fixed orifice opening and requires no cutting to create an opening. The tip has a constant length which can be used to apply the adhesive at a certain distance spaced from the deepest portion of a flooring plank groove and eliminates any guess work regarding how deep to insert the tip into the groove. The tip also has a projecting lip in the form of an alignment bead at the distal end of the tip, opposite the dispenser body. The projecting lip maintains the end of the tip at a desired distance spaced from the top surface of the groove. The projecting lip also extends substantially across the width of the guide member in a direction parallel to the second direction. The tip design provides for a constant gap between the tip and the floor plank groove that does not change during application such that the adhesive application rate on the groove will not vary.

The adhesive dispenser tip also includes a guide member that extends in a first direction away from the body and is shaped to fit within the groove of a floor board. The guide member has opposing top and bottom surfaces and opposing end surfaces. The tip orifice is in communication with the reservoir. An elongated channel is also provided between or adjacent to the guide member and the orifice. The elongated channel extends in a second direction substantially perpendicular to the first direction. The elongated channel preferably has a substantially arch-shaped cross-section, for example, a segment of a circle that is from about 250° to about 260°. The orifice comprises an opening that is at least partially formed in the side wall of the elongated channel. Preferably, the channel merges with and is continuous with the top surface of the guide member.

The accompanying drawings, which are incorporated in and constitute a part of the present application, illustrate a preferred embodiment of the present invention, and together with the description, serve to further explain the principles of the present invention.

DETAILED DESCRIPTION OF THE PRESENT INVENTION

Figure 1:
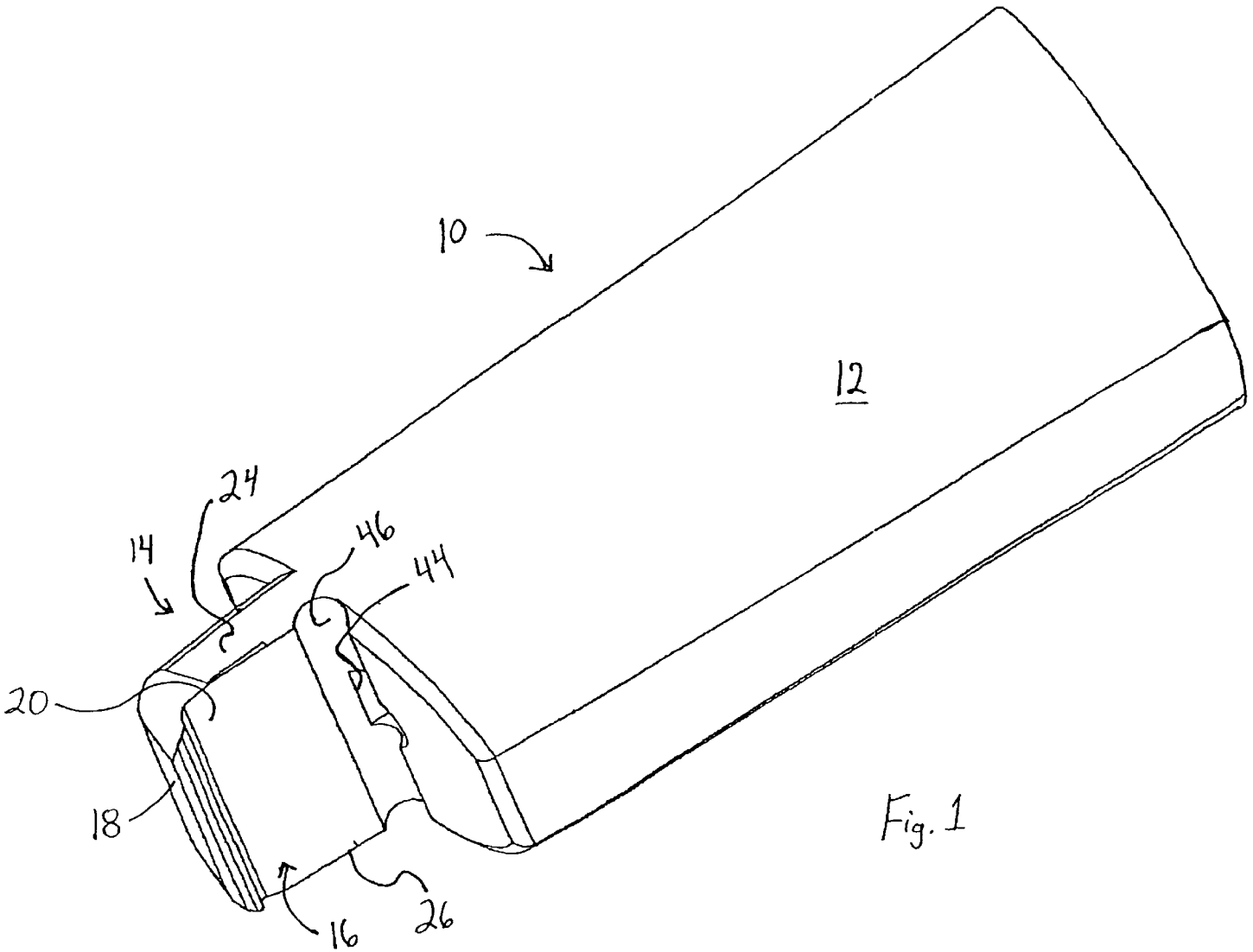
FIG. 1 is a perspective view of an adhesive dispenser according to an embodiment of the present invention.
Figures 2, 3, 4, 5, 6:
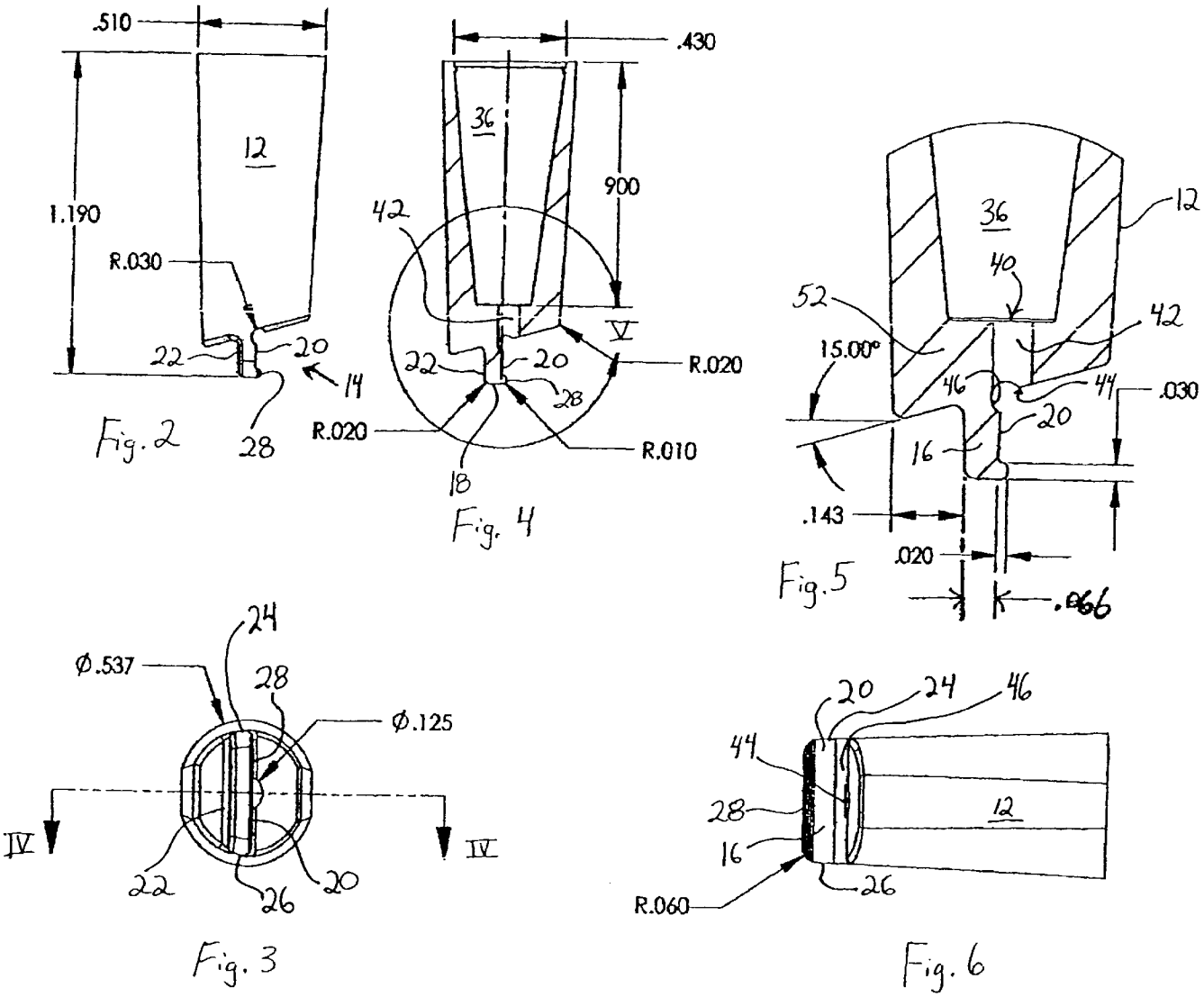
FIG. 2 is a side view of the adhesive dispenser shown in FIG. 1.
FIG. 3 is an end view of the adhesive dispenser shown in FIG. 1.
FIG. 4 is a cut-away view taken along line IV—IV shown in FIG. 3.
FIG. 5 is an enlarged view of the circular section V shown in FIG. 4.
FIG. 6 is a top view of the adhesive dispenser shown in FIG. 1, looking down on the top surface of the guide member.

An adhesive dispenser according to an embodiment of the present invention includes a body having a reservoir for containing an adhesive and a tip as described below. The tip and body can be integrally formed together from a single piece of material or can comprise separate components, for example, a screw-on or snap-on tip that engages with threads or a shoulder on the body. The body and tip can together snap onto or screw onto a supply of adhesive such as a 16 oz. bottle of flooring glue. The body and tip can be integrally formed or separately formed of molded plastic material. After formation, the reservoir in the body can be filled with adhesive. The body can be filled with adhesive from an opening in the body that can be sealed after the reservoir is filled. The body can be in communication with, or include, a supply of adhesive, for example, a 16 oz. bottle of glue or a supply hose or conduit in communication with a much larger supply of adhesive. The reservoir can be filled through an opening in the tip by use of an injection apparatus such as a syringe inserted through the tip opening. Other means of filling the reservoir with adhesive as recognized by those of skill in the art can also be suitably used, including filling through an open bottom of the body which is subsequently hermetically sealed.

While the dispenser of the present invention is particularly suited for dispensing adhesives used for gluing together grooved flooring planks, the dispenser can also be suitable for dispensing other liquids and pastes of various compositions.

The tip of the adhesive dispenser according to the present invention preferably includes a guide member that extends in a first direction away from the body and is shaped to fit within a groove of a grooved flooring plank. The guide member is adapted to fit substantially fully within the groove of a grooved flooring plank and does not extend from the body a distance which is greater than the depth of a groove in a grooved flooring plank in which it is to be inserted. For example, if the dispenser is to be used in conjunction with tongue-and-groove style flooring planks having grooves that are 0.25 inch deep, the tip preferably extends no more than 0.24 inch from the body. At or near the intersection of the body and the tip, one or more shoulders can be provided either on the tip or on the body to prevent further advancement of the tip into the groove. Other shoulder means, abutments, flanges, or mechanisms recognized by those skilled in the art can be used instead of, or in addition to, a shoulder on the body to enable a desirable, consistent, and repeatable positioning of the tip to a desired depth within the groove.

The tip is preferably provided with a fixed orifice opening, eliminating the need to create an opening or cut or slice the tip. The fixed orifice can have any of a variety of shapes, including round, circular, square, and rectangular shapes.

According to a preferred embodiment of the present invention, the tip includes a guide member that extends in a first direction away from the dispenser body and is shaped to fit within a groove of a grooved flooring plank. The guide member can have opposing top and body surfaces and opposing end surfaces. At least the top surface is preferably substantially planar and, when inserted into the groove of a grooved flooring plank, the top surface faces upwardly toward the top surface of the flooring plank.

The tip is also provided with an orifice or opening in communication with the reservoir. The orifice preferably intersects and is preferably at least partially defined by an elongated channel that extends in a second direction substantially perpendicular to the direction the guide member extends away from the body. The elongated channel may be defined by a single sidewall and the orifice can comprise an opening that is at least partially formed in the sidewall. The channel is adapted to receive adhesive expelled from the reservoir through the orifice and directs the adhesive to a desired location along the groove of a grooved flooring plank. The channel can be continuous with the top surface of the guide member and merges with the guide member such that where an edge of the channel ends the top surface of the guide member begins.

The channel can have a substantially arch-shaped cross-section. The arch-shaped cross-section of the channel can comprise a segment of a circle that is from about 250° to about 260°, more preferably, about 255°. Other cross-sectional shapes of the channel can also be suitable according to embodiments of the present invention, including U-shaped, cross-section, a ⊔-shaped cross-section, a partial oval-shaped cross-section, a partial ellipse-shaped cross-section, a partial polygonal-shaped cross-section, or other cross-sections that provide a channel that allows adhesive to flow out of the reservoir even if the pressure on the tip against the flooring plank varies during adhesive dispensing.

At the distal end of the tip, that is, at the end of the tip spaced furthest from the dispenser body, a projecting lip in the form of an alignment bead or spacing ridge is provided to maintain the top surface of the guide member spaced away from the top of a flooring plank groove. The projecting lip maintains a specified gap between the nozzle tip and the flooring plank groove, preventing the gap from changing and providing a consistent adhesive application rate along the length of the groove.

The present invention also relates to a combined grooved flooring plank and adhesive dispenser according to the present invention. According to the combination, the grooved flooring plank includes a groove having a depth of a first dimension and the tip of the dispenser includes a guide member that extends for a second dimension from a shoulder on the dispenser. The second dimension is less than the first dimension. When the tip including the guide member is inserted into the flooring plank groove, the shoulder or other stop means prevents the guide member from advancing to the deepest dimension of the groove.

The present invention also relates to a method for applying a bead of adhesive to the groove of a grooved flooring plank through the use of an adhesive dispenser in accordance with the present invention. The method includes inserting the guide member of an adhesive dispenser of the present invention into a groove of a grooved flooring plank, then expelling adhesive from the dispenser while moving the dispenser along the length of the groove to form a bead of adhesive of consistent thickness and shape along the length of the groove.

The present invention will now be described with reference to the drawing figures wherein FIGS. 1–8 relate to an embodiment of the present invention. As shown in the drawing figures, an adhesive dispenser 10 includes a dispenser body 12 and a tip 14. The tip 14 includes a guide member 16 that extends in a first direction away from the body 12. The guide member is provided with a distal end 18, a top surface 20, a bottom surface 22 that opposes the top surface 20, and opposing end surfaces 24 and 26. The distal end 18 of the guide member 16 is provided with a projecting lip 28 which, as shown in FIG. 7, spaces the top surface 20 of the guide member 16 away from the top 30 of a groove 32 of a grooved flooring plank 34.

In the interior of body 12 is a reservoir 36 is provided for containing a liquid or paste material such as a flooring plank adhesive 38. The reservoir has an opening 40 which may be of sufficient size to permit the pressurized flow of adhesive 38 from reservoir 36 when the reservoir 36 is positioned above the opening 40. The opening 40 leads to a conduit 42 which passes through the angled front wall 52 of body 12 to form an orifice 44 which is at least partially defined by a channel 46. Preferably, the channel 46 has an arch-shaped cross-section which can be a segment of a circle, as shown in the drawing figures. The arch-shaped cross-section of the channel can comprise a segment of a circle that is from about 250° to about 260°, for example, about 255° as shown.

The adhesive dispenser of the present invention can be provided with a plug or seal for opening 44 to prevent evaporation, drying, and leakage of liquid or paste within the dispenser. Alternatively, or in addition to a plug, a cap (not shown) can be provided that could cover and seal the tip 14 of the dispenser.

Figure 7:
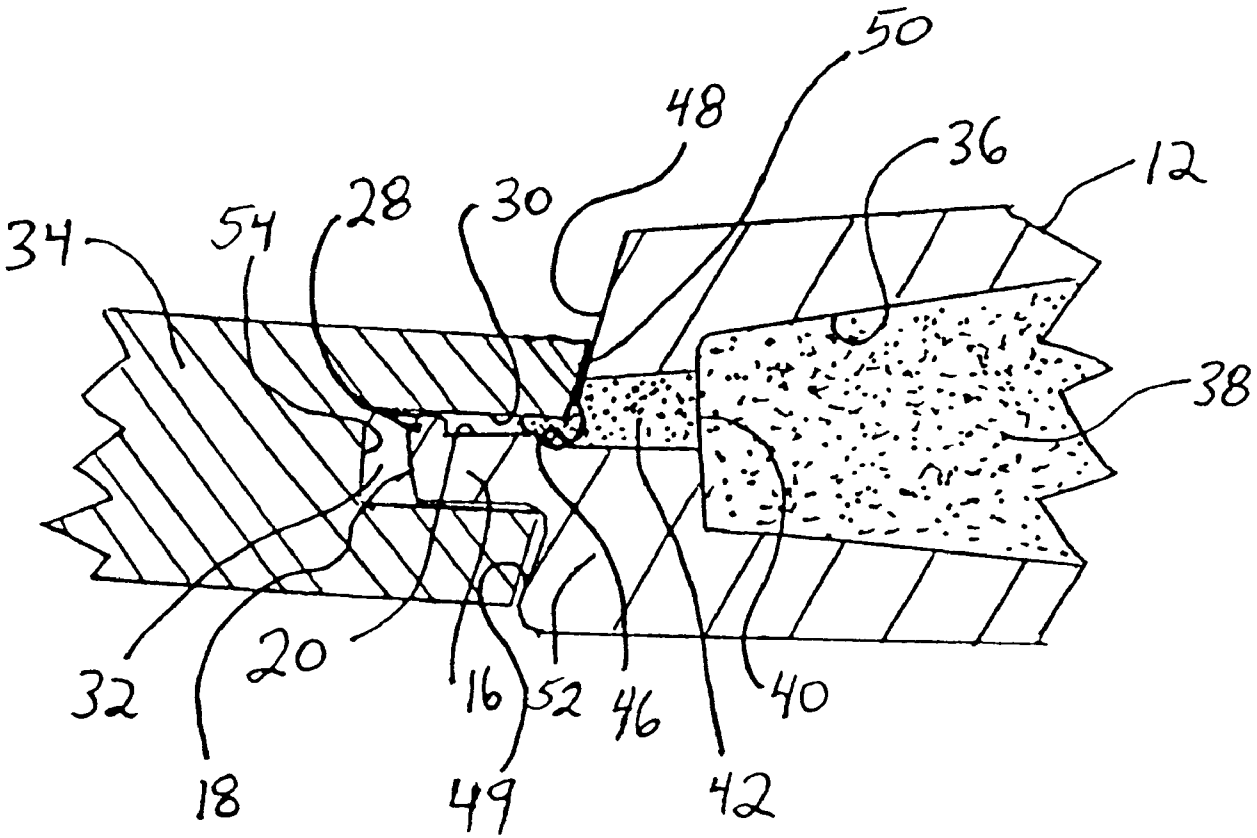
FIG. 7 is a cut-away view of a dispenser according to an embodiment of the present invention, inserted into the groove of a grooved flooring plank.

As shown in FIG. 7, the shape of tip 14 including channel 46, guide-member 16 and projecting lip 28, confines expelled adhesive to the upper surface of groove 32 and prevents the adhesive from contacting undesirable portions of the groove 32.

As can be seen in the drawing figures, the tip 14 of the dispenser intersects with dispenser body 12 at a top shoulder 48 and bottom shoulder 49 on the dispenser body 12. When the guide member 16 of tip 14 is fully inserted within groove 32 as shown in FIG. 7, top shoulder 48 abuts longitudinal edge 50 of flooring plank 34 preventing the distal end 18 of tip 14 from reaching the deepest portion 54 of groove 32 and preventing bottom shoulder 49 from contacting edge 50 of the flooring plank. Although bottom shoulder 49 extends further than top shoulder 48 with respect to the body 12 as shown in FIG. 7, the edge 50 of a sloped edge flooring plank maybe of such an angle that only top shoulder 48, and not bottom shoulder 49, contacts edge 50.

Figure 8:
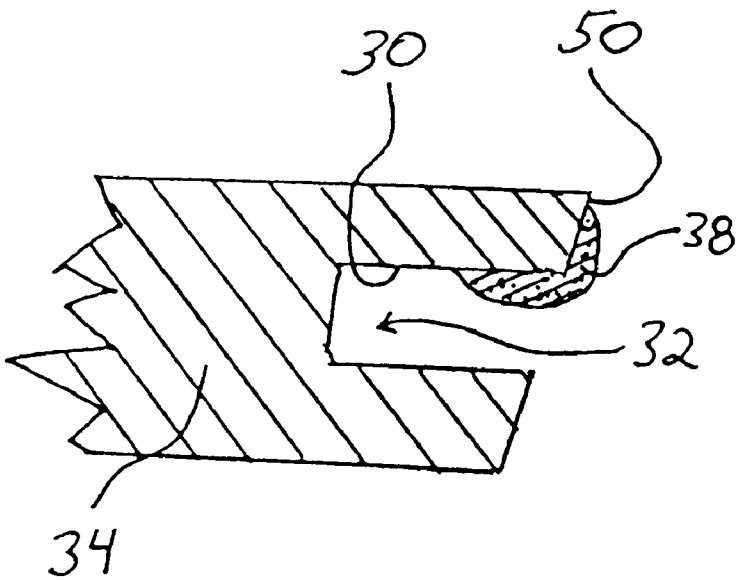
FIG. 8 is a cut-away view showing the bead of adhesive resulting from application of adhesive from the dispenser and method of the present invention shown in FIG. 7.

In accordance with a method of the present invention, adhesive is applied from the dispenser 10 to the groove 32 by expelling adhesive through opening 44 while sliding the dispenser along the length of groove 32. Even when varying pressures are exerted on the dispenser body, the shape of the channel 46 and design of the tip provides delivery of a consistent and uniform bead of adhesive to the upper surface 30 of groove 32 as best seen in FIGS. 7 and 8.

Other embodiments of the present invention will be apparent to those skilled in the art from consideration of this specification and practice of the present invention disclosed herein. It is intended that the specification and examples be considered as exemplary only, with a true scope and spirit of the invention being indicated by the following claims and equivalents thereof.

What is claimed is:

1. An adhesive dispenser comprising:

a body having a reservoir for containing an adhesive; and a tip, said tip comprising:

a guide member that extends in a first direction away from said body and is shaped to fit within a groove of a grooved flooring plank, said guide member having opposing top and bottom surfaces and opposing end surfaces;

an orifice in communication with said reservoir; and an elongated channel that extends in a second direction that is substantially perpendicular to said first direction, said elongated channel having a sidewall, wherein said orifice comprises an opening that is at least partially formed in said sidewall, said channel adapted for receiving adhesive expelled from said reservoir through said orifice, and wherein said channel intersects said top surface.

2. The adhesive dispenser of claim 1, wherein said channel has a substantially arch-shaped cross-section.

3. The adhesive dispenser of claim 2, wherein said arch-shaped cross-section comprises a segment of a circle that is from about 250° to about 260°.

4. The adhesive dispenser of claim 3, wherein said segment is about 255°.

5. The adhesive dispenser of claim 1, wherein said guide member has a projecting lip at a distal end thereof, said projecting lip extending substantially across the width of said guide member in a direction parallel to said second direction and extending above said top surface.

6. The adhesive dispenser of claim 5, wherein said top surface is substantially planar and said projecting lip extends substantially perpendicularly above the substantially planar top surface.

7. The adhesive dispenser of claim 1, further comprising an adhesive contained in said reservoir.

8. The adhesive dispenser of claim 7, wherein said adhesive is a flooring plank adhesive.

9. In combination, the adhesive dispenser of claim 1 and a floor plank, wherein said floor plank has a groove along a longitudinal edge thereof, and said guide member is positioned within said groove.

10. The combination of claim 9, wherein said flooring plank comprises a wooden material.

11. The combination of claim 9, wherein said tip intersects said body at a shoulder and said shoulder abuts the longitudinal edge of said flooring plank.

12. The combination of claim 9, wherein the guide member has a projecting lip at a distal end thereof, said projecting lip extending substantially across the width of said guide member in a direction parallel to said second direction and extending above said top surface.

13. The combination of claim 12, wherein said top surface is substantially planar and said projecting lip extends substantially perpendicularly above the substantially planar top surface.

14. The combination of claim 12, wherein said distal end extends from said shoulder a first dimension which is less than the depth dimension of said groove.

15. A method of applying adhesive to a groove of a grooved flooring plank, said method comprising:

providing an adhesive dispenser, said adhesive dispenser comprising a body having a reservoir containing an adhesive;

a tip, said tip comprising:

a guide member that extends in a first direction away from said body and is shaped to fit within a groove of a grooved flooring plank, said guide member having opposing top and bottom surfaces and opposing end surfaces;

an orifice in communication with said reservoir;

an elongated channel that extends in a second direction that is substantially perpendicular to said first direction, said elongated channel having a sidewall, wherein said orifice comprises an opening that is at least partially formed in said sidewall, said channel adapted for receiving adhesive expelled from said reservoir through said orifice, and wherein said channel intersects said top surface;

said method further comprising:

inserting said guide member into a groove of a grooved flooring plank; and expelling adhesive from said dispenser onto a surface of said groove while moving the guide member along the length of said groove.

16. The method of claim 15, wherein said channel has a substantially arch-shaped cross-section.

17. The method of claim 16, wherein said arch-shaped cross-section comprises a segment of a circle that is from about 250° to about 260°.

18. The method of claim 17, wherein said segment is about 255°.

19. The method of claim 15, wherein said guide member has a projecting lip at a distal end thereof, said projecting lip extending substantially across the width of said guide member in a direction parallel to said second direction and extending above said top surface.

20. The method of claim 19, wherein said top surface is substantially planar and said projecting lip extends substantially perpendicularly above the substantially planar top surface.

21. A plurality of flooring planks adhered together using at least in part the method of claim 15.

* * * * *